US005709425A

United States Patent [19]

Cordova

[11] Patent Number: 5,709,425

[45] Date of Patent: Jan. 20, 1998

[54] CARRIER FOR SKATES AND OTHER ARTICLES

[76] Inventor: Marcos Cordova, 136 E. 208th St., Bronx, N.Y. 10467

[21] Appl. No.: 726,629

[22] Filed: Oct. 7, 1996

[51] Int. Cl.[6] ..... A45F 5/10; A47F 7/08

[52] U.S. Cl. ..... 294/162; 294/143; 294/158; 294/169; 211/38

[58] Field of Search ..... 294/15, 16, 26, 294/137, 142, 143, 145, 158–160, 162, 169, 170; 211/34, 37, 38; 12/120.5

[56] References Cited

U.S. PATENT DOCUMENTS

| | | | |
|---|---|---|---|
| 2,603,393 | 7/1952 | Oblusteel | 12/120.5 |
| 2,625,308 | 1/1953 | Green | 294/143 |
| 2,787,379 | 4/1957 | Fritz et al. | 211/38 |
| 3,552,612 | 1/1971 | Greis | 294/145 |
| 4,112,542 | 9/1978 | Snyder | 294/169 |
| 4,279,366 | 7/1981 | Kessler et al. | 294/162 |
| 4,288,012 | 9/1981 | Doak | 294/143 |
| 4,331,357 | 5/1982 | Contreras | 294/145 |
| 4,823,962 | 4/1989 | Arias | 211/34 |
| 5,558,383 | 9/1996 | Lancellotti | 294/159 |

*Primary Examiner*—Dean Kramer
*Attorney, Agent, or Firm*—Michael I. Kroll

[57] ABSTRACT

A carrier (10) for skates (12) and other articles comprising an elongate upstanding member (14). A structure (16) on a lower end of the elongate upstanding member (14), is for holding a pair of skates (12) and other articles in a side-by-side hang down relationship. A facility (18) on an upper end of the elongate upstanding member (14), in a first instance is for grasping by a hand (20) of a person (22), so as to transport the pair of skates (12) and other articles. In a second instance the facility (18) is for hanging, such as on a pole (24) in a closet (26), to allow the pair of skates (12) and other articles to be stored for future use.

11 Claims, 4 Drawing Sheets

Fig. 2
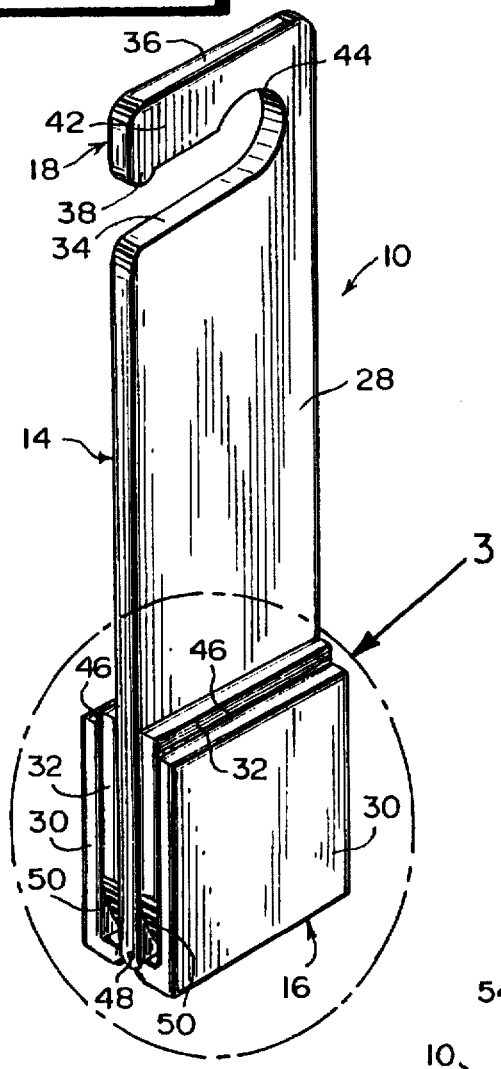
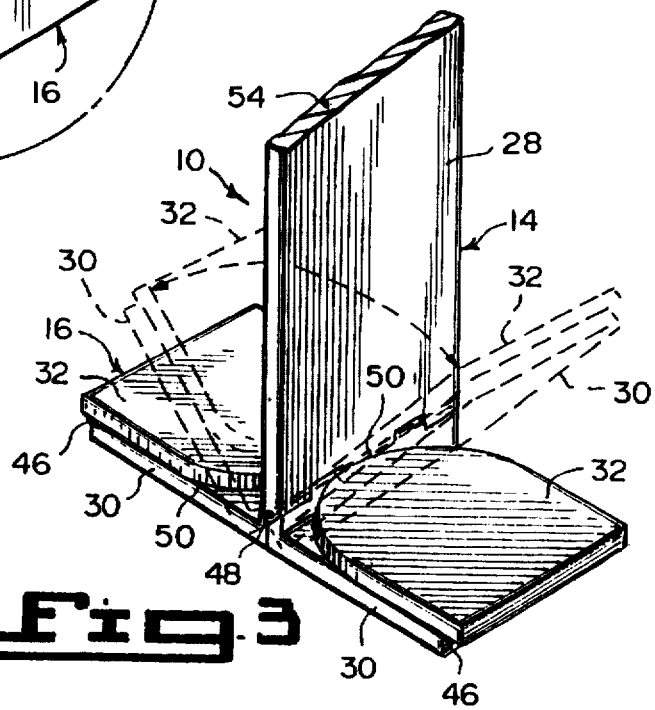
Fig. 3

CARRIER FOR SKATES AND OTHER ARTICLES

BACKGROUND OF THE INVENTION

1. Field of the Invention

The instant invention relates generally to carriers and more specifically it relates to a carrier for skates and other articles.

2. Description of the Prior Art

Numerous carriers have been provided in prior art. For example, U.S. Pat. Nos. 4,277,006 to Pinckard; 4,279,366 to Kessler et al.; 4,363,514 to Buffum; 5,269,580 to Hsiao; Des. 260,575 to Brown Jr.; and Des. 335,576 to Phillpott all are illustrative of such prior art. While these units may be suitable for the particular purpose to which they address, they would not be as suitable for the purposes of the present invention as heretofore described.

PINCKARD, WILLIAM A.

ROLLER SKATE CARRIER

U.S. Pat. No. 4,277,006

By providing a novel configured wheel-engaging stand portion adjustably spaced from a similarly configured, spring-biased wheel-engaging clamping portion. The combination being joined by a shaft having a handle at the extremity thereof remote from the stand portion. A roller skate carrier is provided that is self-standing, easy to load and unload and can accommodate any existing roller skate, including those with rear stops, toe stops or both.

KESSLER, MILTON

KESSLER, RONALD N.

ROLLER SKATE CARRIER

U.S. Pat. No. 4,279,366

A carrier for releasably receiving, retaining, carrying and hanging a pair of roller skates includes a C-shaped handle having upper and lower leg portions which overlie each other and which extend substantially in a common plane. The upper leg portion is of sufficient size relative to the size of one's hand to effectively distribute the load of a pair of roller skates across the width of one's hand. The lower leg portion is provided with an opening through which a shaft extends in a direction substantially perpendicular to at least a part of the lower leg portion. Opposite end regions of the shaft project from opposite sides of the opening. Two separate pairs of hook-shaped arm members are carried on opposite end regions of the shaft. Each pair includes arm members located on opposite sides of the C-shaped handle for engaging a rear axle of a skate. The arm members of each pair are spring biased in directions relatively away from each other, but may be moved relatively toward each other as required for the arm members to be inserted between the inside surfaces of a pair of skate wheels. The shaft is rotatable with respect to the C-shaped handle, thereby enabling the arm members to be moved in unison between a storage position wherein they overlie opposite sides of the handle, and an operative position wherein they depend from the handle. A detent assembly is interposed between the shaft and the handle, to selectively releasably retain the arm members in their operative and storage positions.

BUFFUM, RICHARD J.

CARRIER FOR SKATES

U.S. Pat. No. 4,363,514

A carrier for a pair of skates, such as roller skates or ice skates or the like, wherein the skates have a shoe supported on a wheeled plate, and a jump bar spaced from the bottom of the plate. The carrier including a support or carrying bar extending from a pair of upper and lower spaced flanges with an adjustable bar between the flanges for securely gripping the skates between the plate and the jump bar thereof.

HSIAO, LOUIS

IN-LINE SKATE CARRIER

U.S. Pat. No. 5,269,580

In-line skates comprise a boot, an inverted longitudinal channel secured to the sole of the boot and rollers rotatably mounted in the channels. The invention comprises a body having two laterally spaced pockets, each having side supports dimensioned to engage opposite sides of the skate channel to hold the boots side-by-side and having a hook to hook around one of the rollers (preferably the forward-most roller). The forward ends of the pocket-forming portions are connected by a transverse member to which a carrying handle is attached. A retainer is resiliently attached to the body, to apply pressure to the boots to prevent them from popping out of the pockets.

BROWN, JR., FRED W.

ROLLER SKATE CARRIER

U.S. Pat. No. Des. 260,575

The ornamental design for a roller skate carrier, substantially as shown and described.

FIG. 2 is a top plan view;

FIG. 3 is a right side elevational view; and

PHILLPOTT, WILLIAM T.

SKATE SLING CARRIER

U.S. Pat. No. Des. 335,576

The ornamental design for a skate sling carrier, as shown and described.

Figure 1:
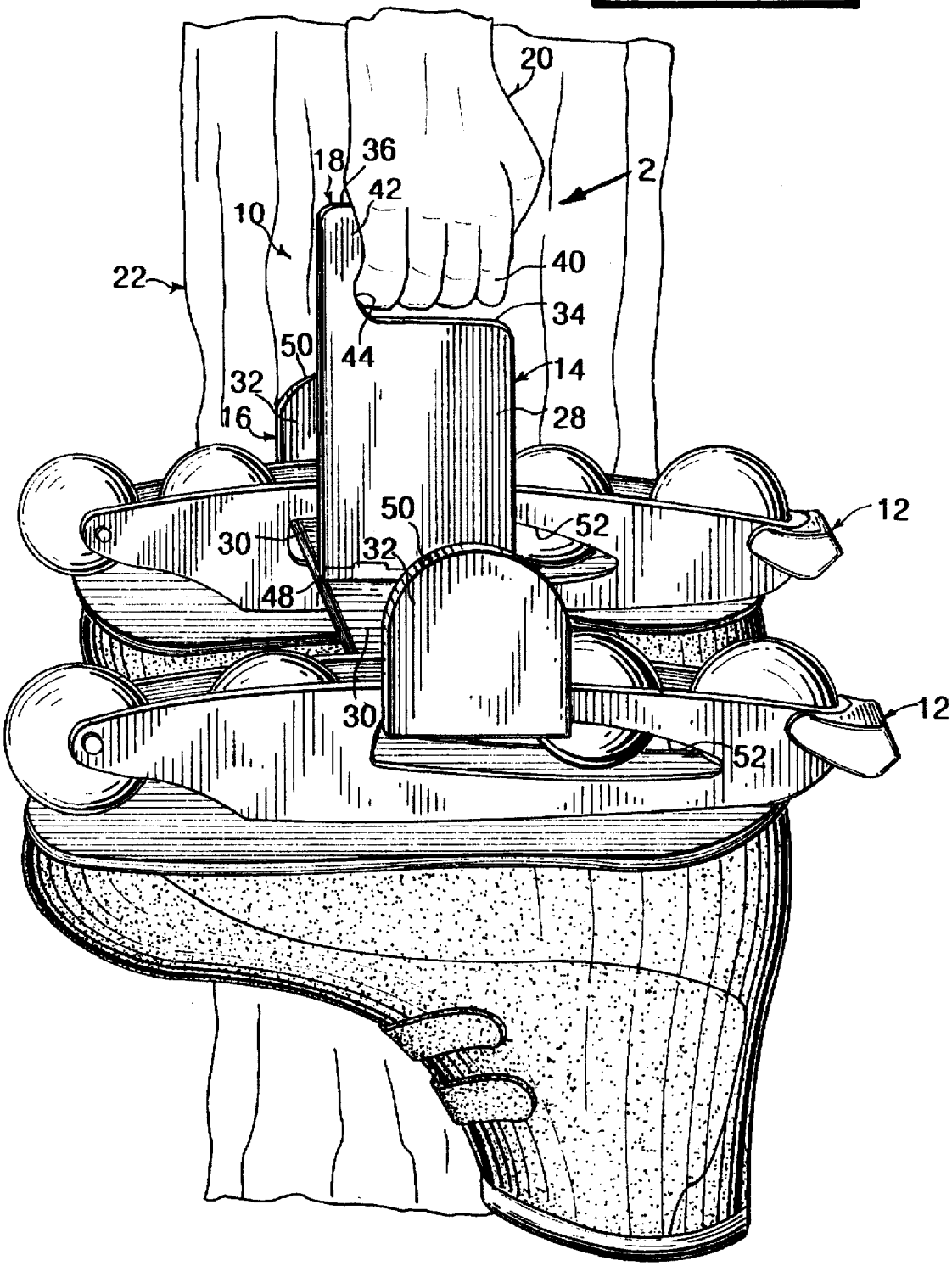
FIG. 1 is a perspective view of a roller skate carrier showing the new design.
Figure 4:
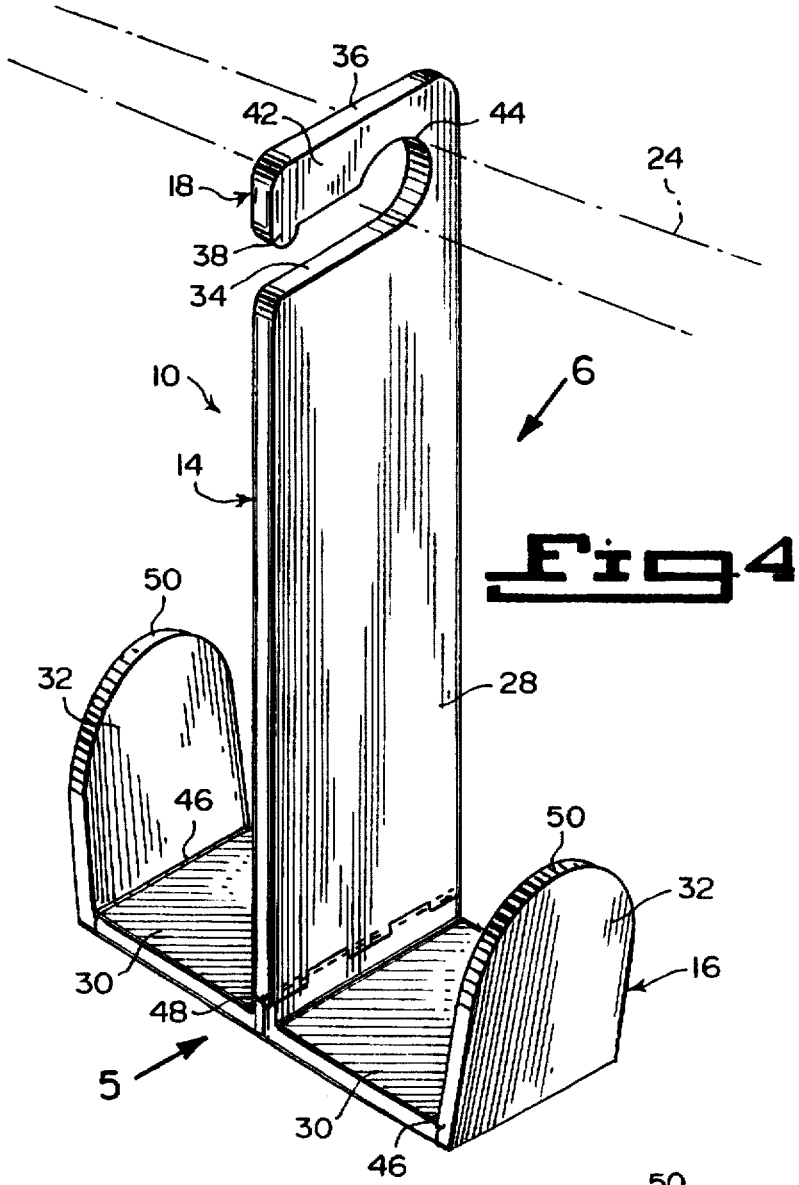
FIG. 4 is a rear elevational view thereof.

FIG. 1 is a front elevational view of a skate sling carrier, showing the new design;

FIG. 2 is a side elevational view, the opposite side being a mirror image thereof;

FIG. 3 is a rear elevational view thereof;

FIG. 4 is a top plan view thereof; and

Figure 5:
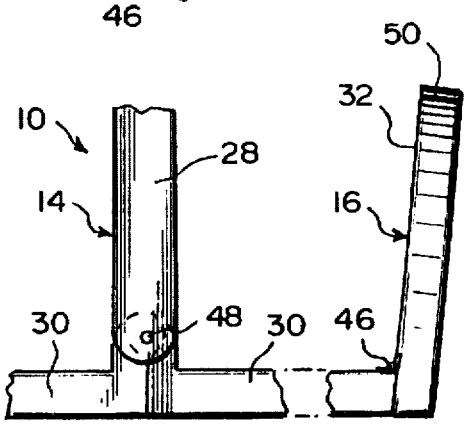

FIG. 5 is a bottom plan view thereof.

SUMMARY OF THE INVENTION

A primary object of the present invention is to provide a carrier for skates and other articles that will overcome the shortcomings of the prior art devices.

Another object is to provide a carrier for skates and other articles that contains a handle, which can be grasped by a hand of a person to transport two of any type of articles in a side-by-side relationship, such as in-line skates, ice skates, roller skates, cans of soda, shopping bags and the like.

An additional object is to provide a carrier for skates and other articles in which the handle can act as a hook, so that it can be hung on a pole in a closet, allowing the two articles to be stored in the closet for future use.

A further object is to provide a carrier for skates and other articles that is simple and easy to use.

A still further object is to provide a carrier for skates and other articles that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view showing the instant invention in use being carried by a hand of a person.

FIG. 2 is a perspective view of the instant invention per se taken in the direction of arrow 2 in FIG. 1, shown completely closed.

FIG. 3 is a perspective view of a lower portion of the instant invention as indicated by arrow 3 in FIG. 2, shown partly opened.

FIG. 4 is a perspective view similar to FIG. 2, showing the instant invention fully opened.

FIG. 5 is a partial elevational view with parts broken away taken in the direction of arrow 5 in FIG. 4.

Figure 6:
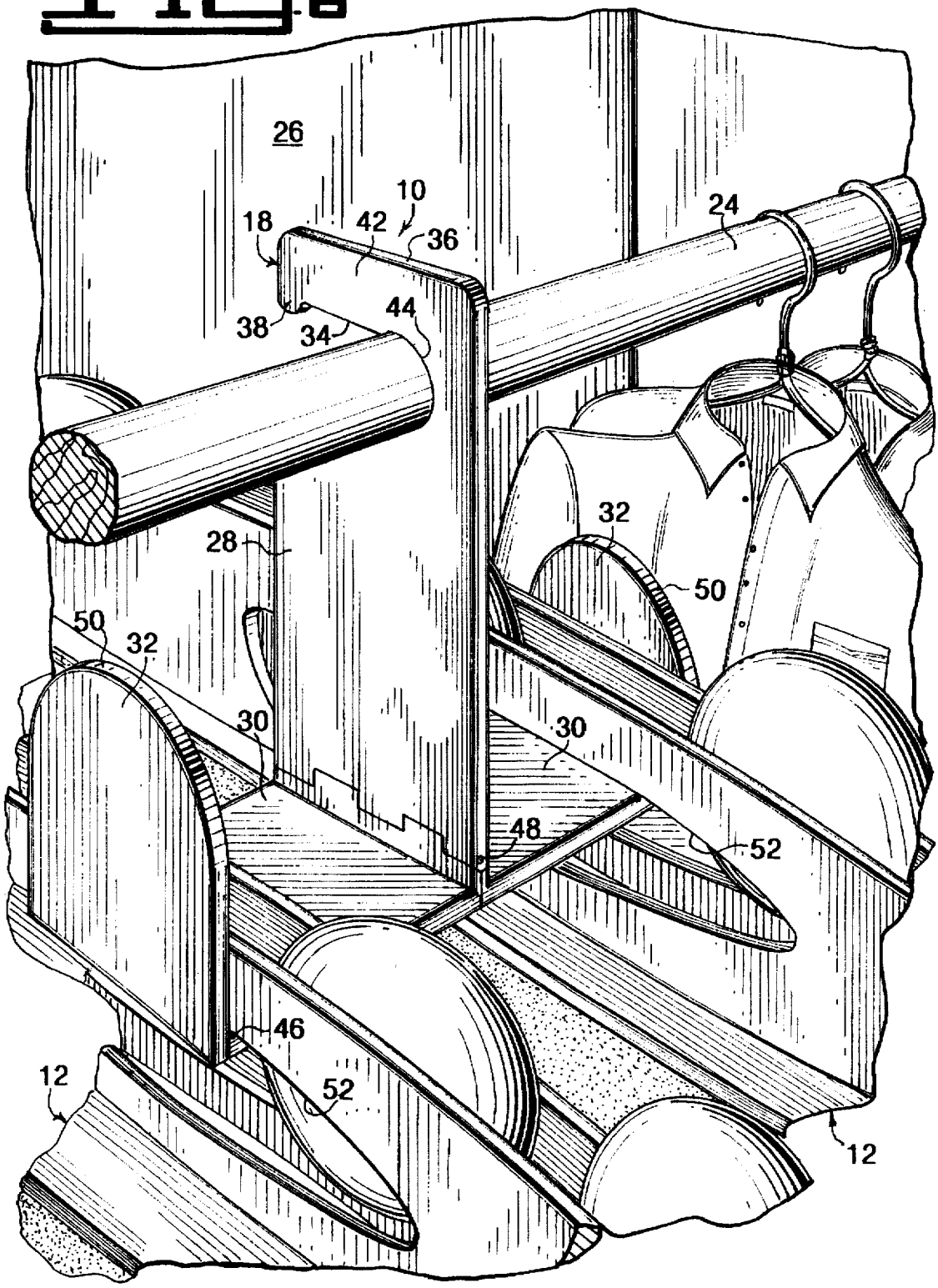

FIG. 6 is a perspective view with parts broken away taken in the direction of arrow 6 in FIG. 4, showing the instant invention hung on a pole in a closet storing a pair of in-line skates therein.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 6 illustrate a carrier 10 for skates 12 and other articles, comprising an elongate upstanding member 14. A structure 16 on a lower end of the elongate upstanding member 14, is for holding a pair of skates 12 and other articles in a side-by-side hang down relationship. A facility 18 on an upper end of the elongate upstanding member 14, in a first instance is for grasping by a hand 20 of a person 22, so as to transport the pair of skates 12 and other articles (see FIG. 1). In a second instance, the facility 18 is for hanging, such as on a pole 24 in a closet 26, to allow the pair of skates 12 and other articles to be stored for future use (see FIG. 6).

The elongate upstanding member 14 is a rectangular flat plate 28. The holding structure 16 includes a pair of crossbars 30. Each crossbar 30 extends oppositely from each other at a right angle on the lower end of the elongate upstanding member 14. The holding structure 16 further contains a pair of arms 32. Each arm 32 extends upwardly on a distal end of one crossbar 30.

The grasping and hanging facility 18 consists of the elongate upstanding member 14 having a horizontal cutout slot 34 extending inwardly from one side adjacent a top end 36 thereof. The slot 34 has a downward front projection 38, to allow fingers 40 of the hand 20 of the person 22 to fit comfortably within the slot 34, to grasp a portion 42 of the elongate upstanding member 14 between the slot 34 and the top end 36, which functions as a handle. The slot 34 also has a curved rear notch 44 to allow the pole 24 in the closet 26 to engage with the curved rear notch 44. The portion 42 of the elongate upstanding member 14 between the slot 34 and the top end 36 now functions as a hook.

A locking hinge 46 is between each crossbar 30 and the arm 32, so that the arms 32 can fold down against the crossbars 30 when not in use. A locking hinge 48 is between the crossbars 30 and the lower end of the elongate upstanding member 14, so that the crossbars 30 can fold up towards the elongate upstanding member 14 when not in use after the arms 32 fold down.

Each arm 32 includes a curved distal free end 50, to allow apertures 52 in the pair of skates 12 and looped handles on two of the other articles, to easily fit over the arms 32 to hang down from the crossbars 30. The elongate upstanding member 14, the holding structure 16 and the grasping and hanging facility 18 are all fabricated out of a lightweight durable strong material 54. The lightweight durable strong material 54 is plastic.

The skates 12 can be in-line skates (roller blades), ice skates or roller skates. The articles can be paper bags, shopping bags, pocketbooks, packs of soda cans or other packages that have looped handles.

OPERATION OF THE INVENTION

To use the carrier 10, the following steps should be taken:

1. Pull the crossbars 30 down until the locking hinge 48 stops the crossbars 30 at a right angle to the lower end of the elongate upstanding member.

2. Lift the arms 32 up until the locking hinges 48 stop the arms 32, so that the arms 32 extend upwardly from the crossbars 30.

3. Place the apertures 52 of the pair of skates 12 or the looped handles of the other articles over the arms 32, so that they hang down from the crossbars 30 in the side-by-side relationship.

4. Pick up the grasping and hanging facility 18 by the fingers 40 of the hand 20, to transport the skates 12 or other articles from place to place.

5. Put the grasping and hanging facility 18 onto the pole 24 in the closet 26, to store the skates 12 or other articles from future use.

LIST OF REFERENCE NUMBERS 10 carrier
12 skate
14 elongate upstanding member of 10
16 holding structure of 10
18 grasping and hanging facility of 10
20 hand of 22
22 person
24 pole in 26
26 closet
28 rectangular flat plate for 14
30 crossbar of 16

32 arm of 16

34 horizontal cutout slot of 18

36 top end of 14

38 downward front projection of 34

40 finger on 20

42 portion of 14 between 34 and 36

44 curved rear notch of 34

46 locking hinge between 30 and 32

48 locking hinge between 14 and 30

50 curved distal free end of 32

52 aperture in 12

54 lightweight durable strong material

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A carrier for skates or other articles comprising:

a) an elongate upstanding member;

b) means on a lower end of said elongate upstanding member, for holding a pair of skates or other articles in a side-by-side hang down relationship, said holding means including:

i) a pair of crossbars, each said crossbar extending oppositely from each other at a right angle on said lower end of said elongate upstanding member;

ii) a pair of arms, each said arm extending upwardly on a distal end of one said crossbar; and iii) a locking hinge between each said crossbar and said arm, so that said arms can fold down against said crossbars when not in use; and c) means on an upper end of said elongate upstanding member, in a first instance for grasping by a hand of a person, and in a second instance for hanging said carrier for storage.

2. A carrier as recited in claim 1, wherein said elongate upstanding member is a rectangular flat plate.

3. A carrier as recited in claim 2, wherein said grasping and hanging means includes:

a) said elongate upstanding member having a horizontal cutout slot extending inwardly from one side adjacent a top end thereof;

b) said slot having a downward front projection, to allow fingers of the hand of the person to fit comfortably within said slot, to grasp a portion of said elongate upstanding member between said slot and said top end which functions as a handle; and c) said slot having a curved rear notch to allow the pole in the closet to engage with said curved rear notch, whereby the portion of said elongate upstanding member between said slot and said top end now functions as a hook.

4. A carrier as recited in claim 3, wherein each said arm includes a curved distal free end, to allow apertures in the pair of skates and looped handles on two of the other articles, to easily fit over said arms to hang down from said crossbars.

5. A carrier as recited in claim 4, wherein said elongate upstanding member, said holding means and said grasping and hanging means are all fabricated out of a lightweight durable strong material.

6. A carrier as recited in claim 5, wherein said lightweight durable strong material is plastic.

7. A carrier as recited in claim 1, wherein said grasping and hanging means includes:

a) said elongate upstanding member having a horizontal cutout slot extending inwardly from one side adjacent a top end thereof;

b) said slot having a downward front projection, to allow fingers of the hand of the person to fit comfortably within said slot, to grasp a portion of said elongate upstanding member between said slot and said top end which functions as a handle; and c) said slot having a curved rear notch to allow the pole in the closet to engage with said curved rear notch, whereby the portion of said elongate upstanding member between said slot and said top end now functions as a hook.

8. A carrier as recited in claim 1, wherein each said arm includes a curved distal free end, to allow apertures in the pair of skates and looped handles on two of the other articles, to easily fit over said arms to hang down from said crossbars.

9. A carrier as recited in claim 1, wherein said elongate upstanding member, said holding means and said grasping and hanging means are all fabricated out of a lightweight durable strong material.

10. A carrier as recited in claim 9, wherein said lightweight durable strong material is plastic.

11. A carrier as recited in claim 1, further including a locking hinge between said crossbars and said lower end of said elongate upstanding member, so that said crossbars can fold up towards said elongate upstanding member when not in use after said arms fold down.

* * * * *